US005627575A

United States Patent [19]

Fujimoto et al.

[11] Patent Number: 5,627,575

[45] Date of Patent: May 6, 1997

[54] INK JET PRINT HEAD AND INK JET PRINTER

[75] Inventors: Hisayoshi Fujimoto; Nobuhisa Ishida, both of Kyoto, Japan

[73] Assignee: Rohm Co., Ltd., Kyoto, Japan

[21] Appl. No.: 281,693

[22] Filed: Jul. 28, 1994

[30] Foreign Application Priority Data

Nov. 30, 1993 [JP] Japan ..... 5-299618

[51] Int. Cl.[6] ..... B41J 2/045

[52] U.S. Cl. ..... 347/40; 347/70

[58] Field of Search ..... 347/40, 70, 94

[56] References Cited

U.S. PATENT DOCUMENTS

| | | | |
|---|---|---|---|
| 4,376,284 | 3/1983 | Bader et al. | 347/40 |
| 4,769,654 | 9/1988 | Tahaka et al. | 347/40 |
| 5,126,764 | 6/1992 | Miyauchi et al. | 347/30 |
| 5,157,420 | 10/1992 | Naka et al. | 347/40 |

FOREIGN PATENT DOCUMENTS 5-254140 10/1993 Japan .

*Primary Examiner*—Alrick Bobb

*Attorney, Agent, or Firm*—Fish & Richardson PC

[57] ABSTRACT

In order to provide an ink jet print head effectively ensuring a stable print quality or capable of reducing the voltage applied to piezoelectric: elements while maintaining the volume displacement of the pressure chambers, and to provide an ink jet printer using the same, the ink jet print head of the present invention comprises a plurality of pressure chambers circularly arranged in a hounds tooth manner for allowing the passage of ink, and a plurality of ink flow paths acting as flow paths for ink flowing from the pressure chambers. It further comprises a diaphragm defining one surface of the pressure chambers, and a plurality of piezoelectric elements which apply a pressure to the pressure chambers to discharge the ink within the pressure chambers from the nozzle through the ink flow paths for printing. The pressure chambers disposed in the external portion of the hounds tooth arrangement have a circumferential length equal to or greater than that of the pressure chambers disposed in the internal portion of the hounds tooth arrangement, and have a radial length equal to or smaller than that of the latter.

11 Claims, 6 Drawing Sheets

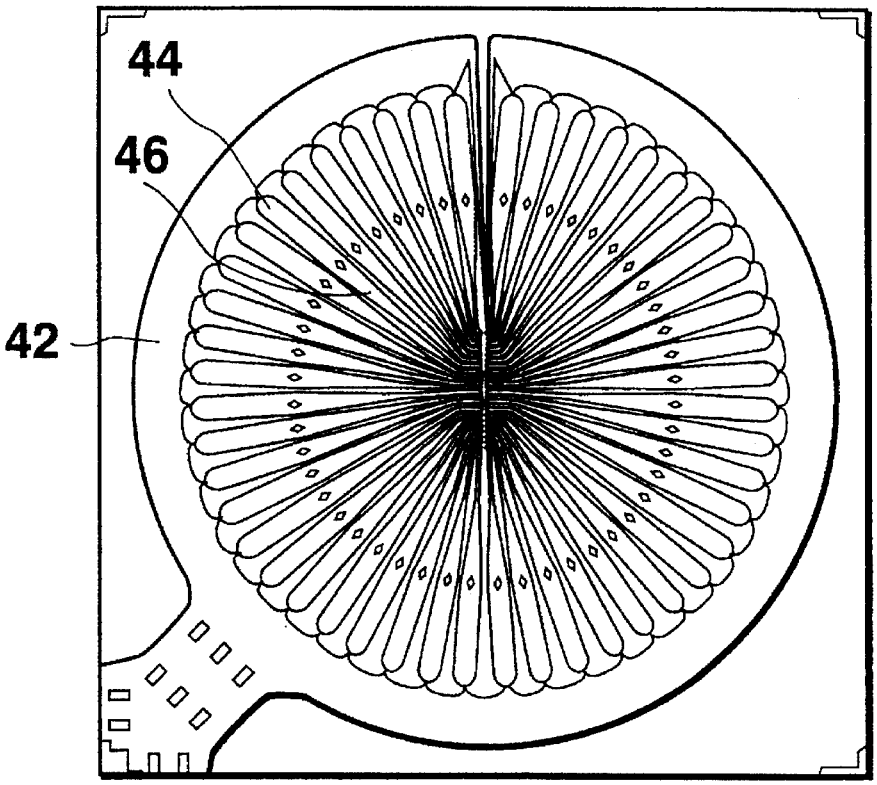
Fig. 8 (a) PRIOR ART
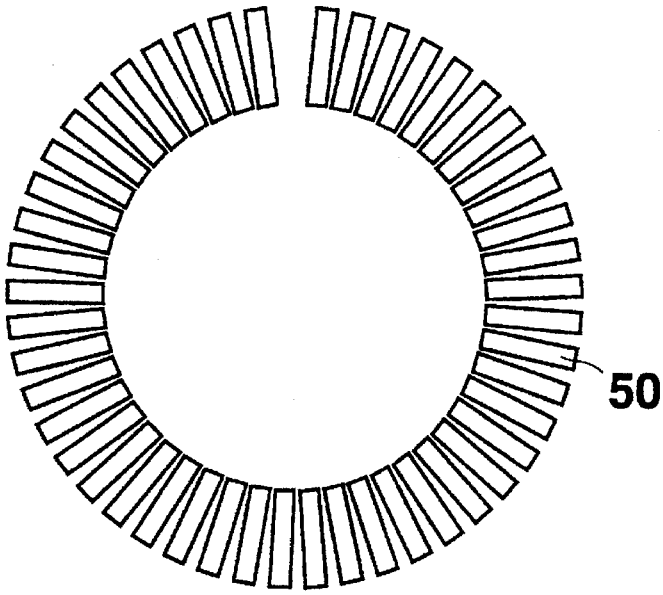
Fig. 8 (b) PRIOR ART

INK JET PRINT HEAD AND INK JET PRINTER

BACKGROUND OF THE INVENTION

1. Field of the Invention

The present invention relates to an ink jet print head for use in printers, facsimile machines, plotters, word processors, etc., and an ink jet printer using the ink jet print head, and more particularly, to an improved structure of pressure chambers and piezoelectric elements for discharging ink from nozzles in a kayser type ink jet print head.

2. Description of the Related Arts

An ink jet printer using an ink jet print head is conventionally known. The ink jet printer is of a type where the print head ejects fine particles of ink without bringing the print head into contact with the print medium. This will lead to advantages such as a wide technical possibility independent from the print medium and the ablity of high-speed printing.

FIGS. 8(*a*) and 8(*b*) depict a structure of a kayser type ink jet print head according to a conventional example (See Japanese Patent Laid-open Pub. No. 5-254140). As shown in FIG. 8(*a*), an ink jet print head comprises a circularly extending ink supply path 42, and a plurality of pressure chambers 44 circularly arranged inside the ink supply path 42 for receiving ink from the ink supply path 42 and reserving the ink. The pressure chambers 44 communicate with corresponding ink paths 46 which lead the ink derived from the pressure chambers 44 to nozzles 48 depicted in FIG. 9. Also, as shown in FIG. 8(*b*), this embodiment has a plurality of circularly arranged piezoelectric elements 50. The piezoelectric elements 50 are correspondingly adhered to the pressure chambers 44 as shown in FIG. 8(*a*).

Upon performing printing by use of this ink jet print head, a voltage is applied to the piezoelectric elements 50 for selective excitation thereof.. Then, the ink from the ink supply path 42 flows into the pressure chambers 44 corresponding to the thus excited piezoelectric elements 50. The ink further flows from the pressure chambers 44 through the ink paths 46 toward the nozzles 48. The flow rate of the ink corresponds to the volume displacement of the pressure chambers 44. A desired quantity of ink is then discharged from the nozzles 48 in hounds tooth arrangement as shown in FIG. 9, to thereby enable stable multi-dot printing. In order to excite the pressure chambers to accomplish stable printing quality in the conventional ink jet print head, a voltage in the order of 40 V must be applied to the piezoelectric elements 50.

It is, however, desirable to further reduce the voltage applied to the piezoelectric elements in view of the production steps including IC mounting, electronic wave faults, safety, and so on. Nevertheless, as described above, a voltage of about 40 V must be applied to the piezoelectric elements to obtain a stable printing quality in the conventional ink jet print head.

To improve the printing quality, it is preferable to increase the discharge quantity of ink while preventing the apparatus from being enlarged in size.

Also, in view of the production cost of the ink jet print head, reduction in size, and so on, it is preferable to form smaller pressure chambers and smaller piezoelectric elements while maintaining a desired discharge quantity.

SUMMARY OF THE INVENTION

The present invention was conceived to solve the above problems, of which objects are to provide an ink jet print head effectively ensuring a stable print quality or capable of reducing the voltage applied to piezoelectric elements while maintaining the volume displacement of the pressure chambers, and to provide an ink jet printer using the same.

In order to accomplish such objects, an ink jet print head according to a first aspect of the present invention comprises a plurality of pressure chambers circularly or arcuately arranged in a hounds tooth arrangement for allowing the passage of ink; a plurality of ink flow paths acting as flow paths for ink flowing from the pressure chambers correspondingly communicating therewith; a diaphragm defining one surface of the pressure chambers and vibrating to apply a pressure to the pressure chambers, thereby discharging the ink within the pressure chambers from nozzles by way of the ink flow paths; and a plurality of piezoelectric elements attached to the external surface of the diaphragm so as to individually correspond to the pressure chambers for applying a voltage to the diaphragm to thereby vibrate the diaphragm: an improvement of the ink jet print head wherein the pressure chambers disposed in the external portion of the hounds tooth arrangement have a circumferential length equal to or greater than that of the pressure chambers disposed in the internal portion of the hounds tooth arrangement, and have a radial length equal to or smaller than that of the pressure chambers disposed in the internal portion of the hounds tooth arrangement.

An ink jet print head according to a second aspect of the present invention comprises a plurality of pressure chambers circularly or arcuately arranged in a hounds tooth arrangement for allowing the passage of ink; a plurality of ink flow paths acting as flow paths for ink flowing from the pressure chambers correspondingly communicating therewith; a diaphragm defining one surface of the pressure chambers and vibrating to apply a pressure to the pressure chambers, thereby discharging the ink within the pressure chambers from nozzles by way of the ink flow paths; and a plurality of piezoelectric elements attached to the external surface of the diaphragm so as to individually correspond to the pressure chambers for applying a voltage to the diaphragm to thereby vibrate the diaphragm: an improvement of the ink jet print head wherein the pressure chambers and the piezoelectric elements disposed in the external portion of the hounds tooth arrangement have a circumferential length equal to or greater than the radial length thereof.

An ink jet print head according to a third aspect of the present invention comprises a plurality of pressure chambers circularly or arcuately arranged in a hounds tooth arrangement for allowing the passage of ink; a plurality of ink flow paths acting as flow paths for ink flowing from the pressure chambers correspondingly communicating therewith; a diaphragm defining one surface of the pressure chambers and vibrating to apply a pressure to the pressure chambers, thereby discharging the ink within the pressure chambers from nozzles by way of the ink flow paths; and a plurality of piezoelectric elements attached to the external surface of the diaphragm so as to individually correspond to the pressure chambers for applying a voltage to the diaphragm to thereby vibrate the diaphragm: an improvement of the ink jet print head wherein the pressure chambers and the piezoelectric elements disposed in the internal portion of the hounds tooth arrangement have a radial length equal to or greater than the circumferential length thereof.

An ink jet printer of the present invention includes an ink jet print head according to the present invention.

In the ink jet print head according to the present invention as described above, the pressure chambers are circularly or arcuately disposed in a hounds tooth arrangement, that is, the pressure chambers are radially arranged from the center of the circle to ensure a larger area accordingly as they extend radially outward. The circumferential length of the pressure chambers disposed in the external portion of the hounds tooth arrangement is equal to or greater than that of the pressure chambers disposed in the internal portion of the hounds tooth arrangement, whereas the radial length of the pressure chambers disposed in the external portion of the hounds tooth arrangement is equal to or smaller than that of the pressure chambers disposed in the internal portion of the hounds tooth arrangement, thereby maximizing the effective utilization of the feature of a radial and hounds tooth arrangement and increasing the volume displacement of the pressure chamber with the voltage conventionally applied to the piezoelectric elements. On the contrary, with the volume displacement of the pressure chambers constant, the piezoelectric elements can be reduced in size to obtain the desired volume displacement.

Also, in the case of using the piezoelectric elements of the same size as the conventional ones, the voltage applied to the piezoelectric elements can be lowered to obtain a desired volume displacement of the pressure chambers.

BRIEF DESCRIPTION OF THE DRAWINGS

FIG. 8(*a*) is a top plan view showing the configuration of the conventional ink jet print head, and FIG. 8(*b*) is a view showing the configuration of the piezoelectric elements.

DESCRIPTION OF THE PREFERRED EMBODIMENT

A preferred embodiment of the present invention will now be described with reference to the accompanying drawings.

Figure 1:
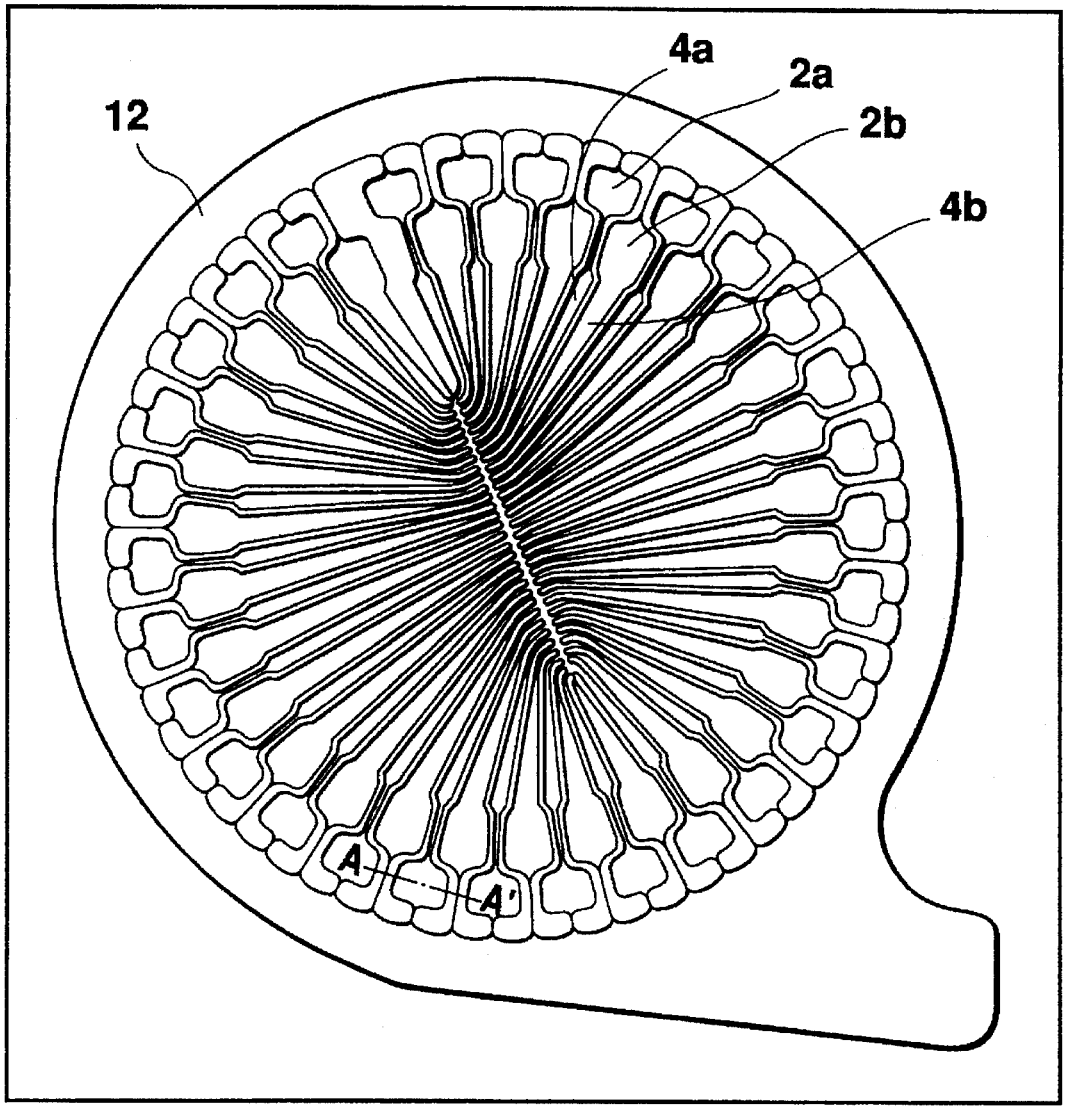
FIG. 1 is a plan view showing the structure of an embodiment of the ink jet print head in accordance with the present invention.

FIG. 1 depicts an ink jet print head constructed in accordance with this embodiment.

Figure 2:
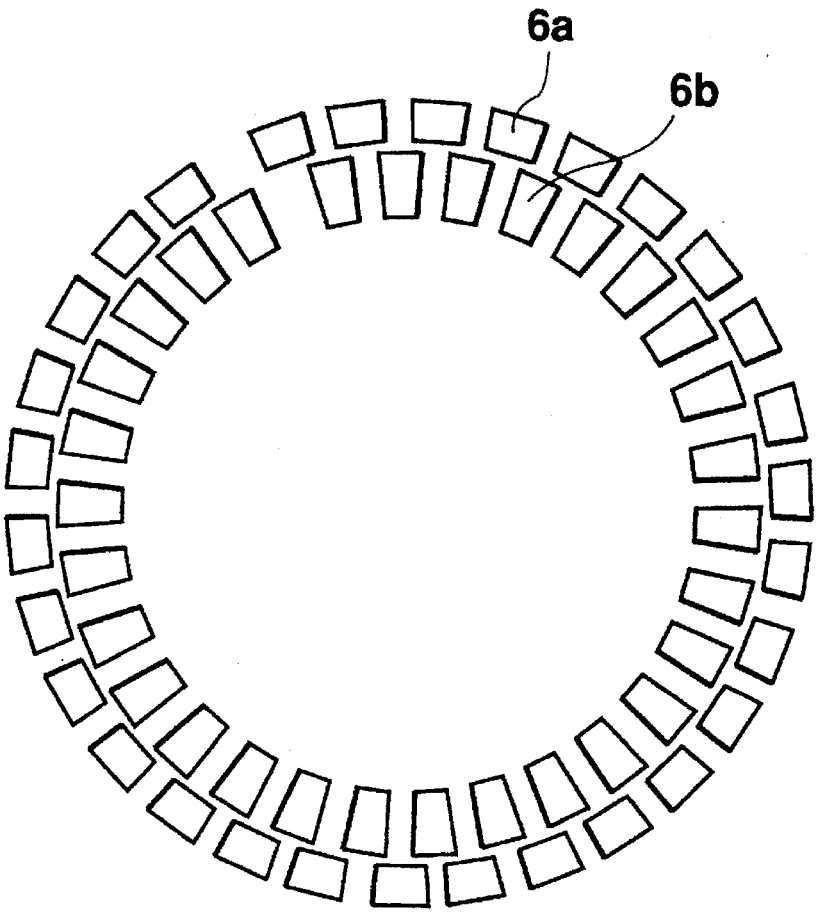
FIG. 2 is a view showing the structure of piezoelectric elements in the embodiment.
Figure 3:
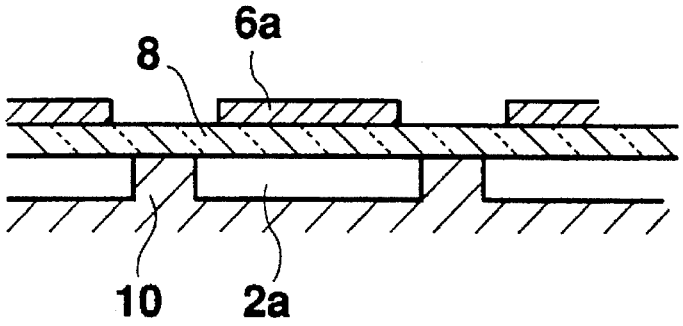
FIG. 3 is a sectional view taken along a line A—A' in FIG. 1, showing a relationship between the piezoelectric elements, diaphragms, and pressure chambers.
Figure 9:
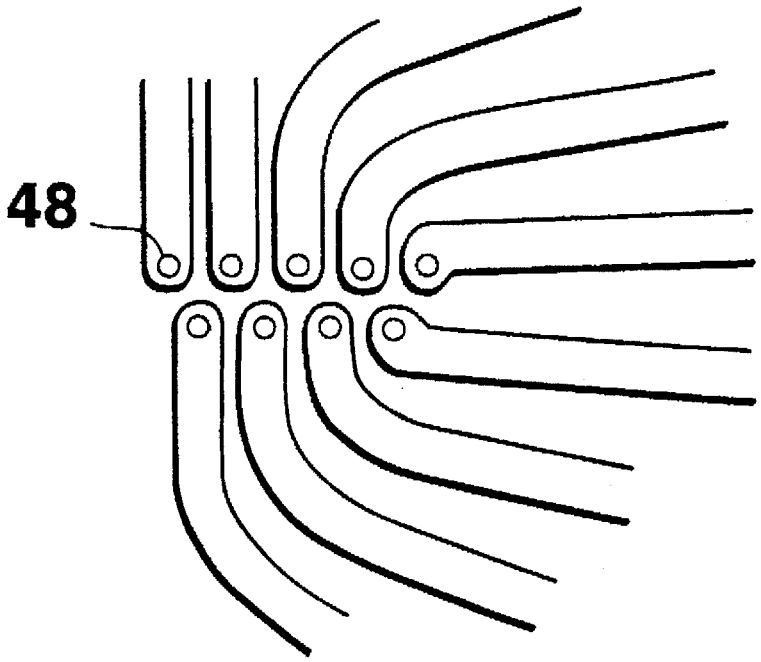
FIG. 9 is a view showing nozzles in the vicinity of the ink jet print head.

The ink jet print head of this embodiment comprises a plurality of pressure chambers 2*a*, 2*b* circularly arranged in a hounds tooth arrangement for allowing the passage of ink, and ink flow paths 4*a*, 4*b* communicating with the pressure chambers 2*a*, 2*b* to flow ink from the pressure chambers 2*a*, 2*b*. As shown in FIG. 2, piezoelectric elements 6*a*, 6*b* are also circularly arranged in a hounds tooth arrangement in this embodiment. FIG. 3, which illustrates a relationship between the pressure chambers 2*a*, 2*b* and the piezoelectric elements 6*a*, 6*b*, is a sectional view taken along a line A—A' in FIG. 1. As is apparent from FIG. 3, a diaphragm 8 made of, e.g. glass, is mounted on a substrate 10 of a material such as photosensitive glass by an adhesive or the like (not shown) so as to define one surface of the pressure chambers 2*a*. The piezoelectric elements 6*a* are adhered on the external surface of the diaphragm 8 so as to correspond to the pressure chambers 2*a*. In printing, the ink jet print head of this embodiment applies a voltage to the piezoelectric elements 6*a* to vibrate the diaphragm 8 which in turn applies a pressure to the pressure chambers 2*a* to thereby discharge the ink within the pressure chambers 2*a* from nozzles by way of the ink flow paths 4*a*. The ink is supplied through an ink supply path 12 into the pressure chambers 2*a* and reserved therein. It will be appreciated that the nozzles in this embodiment can be the nozzles shown in FIG. 9.

This embodiment is characterized in that the pressure chambers 2*a* in the external hounds tooth arrangement, namely, the pressure chambers 2*a* arranged in the outer circle of the pressure chamber arrangement have a circumferential length along the circular arrangement equal to or greater than the pressure chambers 2*b* in the internal hounds tooth arrangement, namely, the pressure chambers 2*b* arranged in the inner circle, of the pressure chamber arrangement. Moreover, the pressure chambers 2*a* in the external arrangement have a radial length in the circular arrangement equal to or smaller than the pressure chambers 2*b* in the internal hounds tooth arrangement. It is also characterized in that the circumferential lengths of the pressure chambers 2*a* and the piezoelectric elements 6*a* are equal to or greater than the radial lengths thereof. The radial lengths of the pressure chambers 2*b* and the piezoelectric elements 6*b* are equal to or greater than circumferential length. This can contribute to the increased quantity from the nozzles if the voltage applied to the piezoelectric elements 6*a*, 6*b* and the areas of the piezoelectric elements 6*a*, 6*b* (hereinafter, referred to as piezo areas) are set in the conventional manner. In other words, a discharge quantity substantially equal to the conventional one can be obtained even though the piezo areas are reduced with the conventional voltage applied to the piezoelectric elements 6*a*, 6*b*. On the contrary, with the piezo areas constant, the voltage applied to the piezoelectric elements 6*a*, 6*b* can be reduced while maintaining the volume displacement between the pressure chambers 2*a*, 2*b*, that is, the quantity to be discharged from a desired nozzle.

Figure 4:
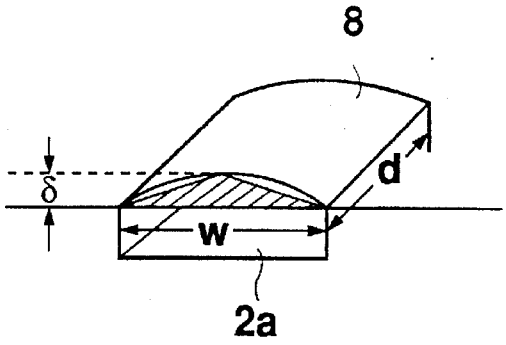
FIG. 4 is a conceptual view showing the diaphragm of this embodiment being bent.

FIG. 4 is a conceptual diagram showing a rectangular diaphragm 8 when the piezoelectric element 6*a* is bent by the application of voltage thereto. The function of this embodiment will be described below with reference to FIG. 4.

The deformation δ (m) in the diaphragm 8 which will occur when bent by the application of voltage can be approximated by the following expression based on the experimental values.

$$\delta=\alpha w^2 v$$

where α is a displacement coefficient, w is a width (m) of the diaphragm 8, and V is an applied voltage (V). Assume the circumferential length w and radial length d of the diaphragm 8 are substantially equal to those of the pressure chambers 2*a* so that the diaphragm 8 can entirely cover the pressure chambers 2*a*. Also, assume the width and length of the diaphragm 8 are substantially equal to those of the piezoelectric elements 6*a*. Substitution of the experimental values $w=8\times10^{-4}$(m), V=40 (V), and $\delta=250\times10^{-9}$ (m) obtained by experiments into the above expression will result in $$\alpha = 250\times10^{-9}/[(8\times10^{-4})^2\times40)]$$
$$\approx 9.77\times10^{-3}(1/m.V)$$

The displacement coefficient can thus be obtained. When actually designing and manufacturing the ink jet printer of this embodiment, the w width of the diaphragm 8 to be employed was $1.1\times10^{-3}$ (m) , and hence under: the same applied voltage the displacement at that time can be expressed as $$\delta = 9.77\times10^{-3}\times(1.1\times10^{-3})^{-2}\times40$$
$$\approx 473\times10^{-9}\ (m)$$

In this manner, widening the diaphragm 8 will result in a greater displacement under the same applied voltage. This will lead to an increase in the quantity discharged from the nozzles.

What is then to be found is the length d of the pressure chamber 2*a* with $w=1.1\times10^{-3}$ (m). The length of the pressure chamber 2*a* when $W=8\times10^{-4}$ (m) is experimentally found to be $d=3.5\times10^{-3}$ (m). If, in order to equalize the volume displacement of the pressure chamber 2*a* by the bend of the diaphragm 8 with $w=8\times10^{-4}$ to the displacement with $w=1.1\times10^{-3}$, the volume displacement is approximated to the hatched portion in FIG. 4, the length d of the pressure chamber 2*a* will result in, through $(8\times10^{-4}\times250\times10^{-9}\times3.5\times10^{-3})/2$ $$= (1.1\times10^{-3}\times473\times10^{-9}\times d)/2,$$
$$d \approx 1.345\ (mm).$$

Accordingly, when approximating the diaphragm 8 to the piezoelectric elements 6*a* in size, the piezo areas relative to the experimental values will result in $$(1.1\times1.345)/(0.8\times3.5)=0.53.$$

In order to obtain the same volume displacement, according to this embodiment, the piezo areas can be reduced about 0.53 times with the same applied voltage. Therefore, the formation of a smaller pressure chamber 2*a* will lead to an increase in the number of the pressure chambers on the same circumference, which will contribute to an increase in the number of dots.

On the other hand, in order to obtain the displacement $\delta=250\times10^{-9}$ (m) equal to the experimental value where $w=1.1\times10^{-3}$ (m), from the above expression $$V = 250\times10^{-9}/[9.77\times10^{-3}\times(1.1\times10^{-3})^2]$$
$$\approx 21.15\ (V).$$

Therefore, the applied voltage relative to the experimental value is $$21.15/40=0.53.$$

To obtain the same voltage displacement, according to this embodiment, the applied voltage can be reduced about 0.53 times with the same piezo areas. This will lead to a reduced possibility of electronic wave jamming, an improvement in safety, and further to the use of inexpensive IC's, which contributes to the reduction in production cost.

As shown in FIG. 1, the pressure chambers 2*a*, 2*b* of this embodiment are arranged radially from the rectilinear central end. The term "radially" represents a feature that the area is enlarged accordingly as it extends outward. In order to effectively utilize the feature, the pressure chambers 2*a* , 2*b* in this embodiment are arranged in a hounds tooth arrangement. Moreover, as seen in FIG. 1, the pressure chambers 2*a* arranged in the outer circle present a slightly widened shape, whereas the pressure chambers 2*b* arranged in the inner peripheral portion present a slightly elongated shape to effectively lie between the ink flow paths 4*a* communicating with the pressure chambers 2*a*.

On the contrary, as described before, the energy efficiency can be improved by approximating the piezoelectric elements 6*a* to a square. Although it is therefore desirable that the pressure chambers 2*a*, 2*b* be also substantially square, the pressure chambers 2*a*, 2*b* and the piezoelectric elements 6*a*, 6*b* in this embodiment have the above-described shapes for the purpose of most effectively obtaining the volume displacement, that is, the ink discharge quantity of desired pressure chambers 2*a*, 2*b*, while maximizing the effective utilization of the feature of radial and hounds tooth arrangement.

Naturally, if the piezoelectric elements 6*a* are square, then the piezoelectric elements 6*a*, 6*b* must be a square of the same size due to the necessity to equalize the ink flow rate from the externally hounds tooth arranged pressure chamber 2*a* and that from the internally hounds tooth arranged pressure chamber 2*b*.

In order to effectively obtain desired piezoelectric elements 6*a*, 6*b*, it is preferable that the piezoelectric elements 6*a* corresponding to the externally hounds tooth arranged pressure chambers 2*a* have a width greater than the length while the internally hounds tooth arranged pressure chambers 2*b* have a width smaller than the length so as to be derived from the shapes of the hounds tooth arranged pressure chambers 2*a*, 2*b*, as shown in FIG. 1, to approximate the piezoelectric elements 6*a*, 6*b* to a square although they are not actually square. Accordingly, the externally arranged pressure chambers 2*a* and the internally arranged pressure chambers 2*b* have the different configurations.

Once applying a voltage to the piezoelectric elements 6*a*, 6*b* for selective excitation, as described above, the ink from the ink supply path 12 flows into the pressure chambers 2*a*, 2*b* corresponding to the thus excited piezoelectric elements 6*a*, 6*b*. The ink of an equivalent flow rate from the present pressure chamber 2*a*, 2*b* flows through the ink flow paths 4*a* toward the nozzles. The nozzles discharge the ink for printing.

According to this embodiment, therefore, a smaller piezo area or a lower applied voltage can be employed to obtain a flow of ink of a desired equivalent volume displacement from each of the pressure chambers 2*a*, 2*b*, thereby effectively ensuring stable printing.

Figure 5:
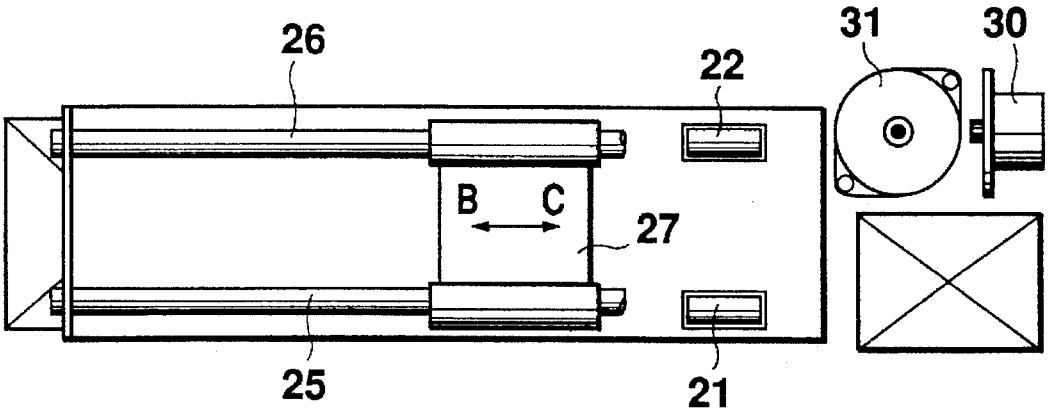
FIG. 5 is a top plan view showing the major part of a ink jet printer incorporating the ink jet print head of the present invention.
Figure 6:
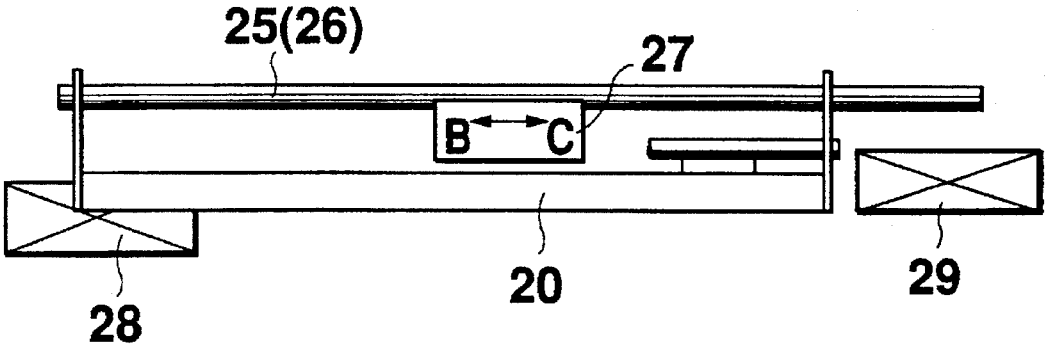
FIG. 6 is a front view showing the major part of the ink jet printer of FIG. 5.
Figure 7:
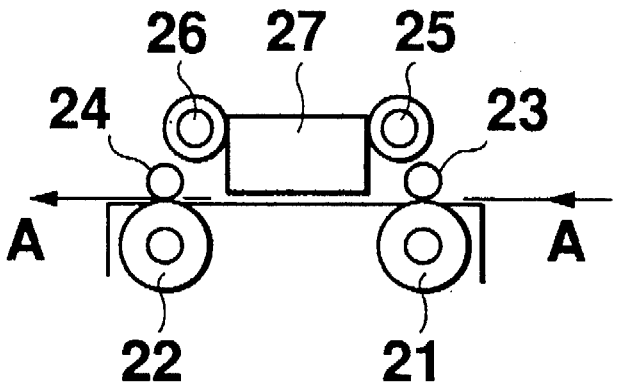
FIG. 7 is a lateral view showing the major part of the ink jet printer of FIGS. 5 and 6.

FIGS. 5, 6, and 7 depict an overall structure of an embodiment of an ink jet printer incorporating the ink jet print head in accordance with the present invention.

In the figures, the ink jet printer includes a flat platen 20 to reduce the size and thickness for use in facsimiles, plotters, or bar code printers. A recording paper not shown is fed toward the flat platen 20 as indicated by an arrow A in FIG. 7. To ensure a correct feed of the recording paper, provided in front of and behind the flat platen 20 are feed rollers 21, 22 for nipping the recording paper in cooperation with idler rollers 23, 24 confronting the rollers 21, 22, respectively, to feed a predetermined amount of paper. Disposed above the flat platen 20 are a pair of carriage guides 25, 26 which bear a carriage 27 reciprocatively in the line direction of the recording paper. Coupled to the carriage 27 is a driving system not shown in detail in which a drive force from a stepping motor or the like moves the carriage 27 to an arbitrary position in the line direction on the recording paper. Accordingly, the carriage 27 is capable of reciprocating in the direction indicated by an arrow BC in FIG. 7.

The carriage 27 incorporates the above-described ink jet print head whose nozzles 48 are so arranged as to confront the recording paper delivered onto the flat platen 20.

To supply ink into the ink jet print head incorporated within the carriage 27, provided below the flat platen 20 is an ink cartridge 28 which directs necessary ink toward the inlet of the ink jet print head by way of, e.g., a flexible tube.

In order to prevent ink within the nozzles 48 of the ink jet print head from hardening when not in use, the ink jet printer is provided with a cleaning unit 29 toward which the carriage 27 retreats the ink jet print head during a non-print mode.

As shown in FIG. 5, the ink jet printer is fitted with a feed motor 30 for conferring a desired driving force on the page ejection and the cleaning unit 29, and with a carriage drive motor 31 for driving, respectively, the feed rollers 21, 22 and the carriage 27, by way of a transmission mechanism not shown.

As described before, the application of the ink jet print head in accordance with the present invention into the ink jet printer will result in an ink jet printer having a good performance with an improved print quality.

In the ink jet print head of the present invention, as detailed hereinabove, the pressure chambers and piezoelectric elements arranged in the external circle have a circumferential length equal to or greater than the radial length, while the pressure chambers and piezoelectric elements arranged in the internal circle have a circumferential length equal to or smaller than the radial length, thereby maximizing the effective utilization of the feature of the radial arrangement and hound's-tooth arrangement of the pressure chambers and enabling the volume displacement of the pressure chamber to be increased with the voltage convention-ally applied to the piezoelectric elements. Alternatively, with the volume displacement of the pressure chamber constant, it is possible to reduce the size of the piezoelectric elements to obtain a desired volume displacement. In the case of using the piezoelectric elements having the same size as the conventional ones, it is possible to reduce the voltage applied to the piezoelectric elements to obtain a desired volume displacement of the pressure chambers, which may contribute to a possible reduction of electronic wave faults and the improvement of safety. This will further result in a possibility of using inexpensive IC's as well as curtailment in production cost.

Mounting the ink jet printer with the ink jet print head will enable the provision of the ink jet printer operable at a lower voltage, having a high safety, or being reduced in size while keeping a high print quality.

What is claimed is:

1. An ink jet print head, comprising:

a plurality of nozzles capable of ejecting ink toward an object;

at least two sets of pressure chambers, each set comprising a plurality of pressure chambers circularly or arcuately arranged around said nozzles, with each pressure chamber having a shape defined by a circumferential length and a radial length;

a plurality of ink flow paths communicating said pressure chambers with corresponding ones of said nozzles;

a diaphragm defining one surface of said pressure chambers, said diaphragm capable of vibrating to apply a pressure to said pressure chambers, thereby causing the ink within said pressure chambers to be discharged from said nozzles by way of said ink flow paths; and a plurality of piezoelectric elements attached to an external surface of said diaphragm to thereby vibrate said diaphragm, wherein a first, outer set of said at least two sets of pressure chambers is disposed radially outside a second, inner set of said at least two sets of pressure chambers, said first set of pressure chambers having (i) a circumferential length equal to or greater than a circumferential length of said second set of pressure chambers, and (ii) a radial length equal to or smaller than a radial length of said second set of pressure chambers.

2. An ink jet print head according to claim 1, wherein said diaphragm is made of a photosensitive glass.

3. An ink jet print head according to claim 1, wherein said diaphragm substantially covers said pressure chambers.

4. An ink jet print head according to claim 1, wherein said diaphragm is substantially equal in size to said piezoelectric elements.

5. An ink let printer including an ink jet print head according to claim 1.

6. An ink jet print head according to claim 1, wherein the pressure chambers in said first set of pressure chambers have a circumferential length equal to or greater than the radial length thereof.

7. An ink jet print head according to claim 1, wherein the pressure chambers in said second set of pressure chambers have a radial length equal to or greater than the circumferential length thereof.

8. An ink jet printer including an ink jet print head according to claim 6.

9. An ink jet printer including an ink jet print head according to claim 7.

10. An ink jet print head, comprising:

a plurality of ink nozzles capable of ejecting ink toward an object;

at least two sets of pressure chambers, each set comprising a plurality of pressure chambers disposed in a circular arrangement around said nozzles and a plurality of ink flow paths in fluid communication with the pressure chambers which supply the ink to corresponding nozzles;

a diaphragm defining a wall of said pressure chambers; and a plurality of piezoelectric elements capable of deforming said diaphragm in response to an application of voltage for changing a volume of corresponding pressure chambers;

wherein the at least two sets of pressure chambers are arranged in a concentric circular arrangement and further wherein the pressure chambers of a first set of said at least two sets of pressure chambers on a radially outer circle are in an alternate arrangement relative to the pressure chambers of a second set of said at least two sets of pressure chambers on a radially inner circle.

11. An ink jet print head according to claim 10, wherein said pressure chambers of said first set have ink flow paths extending between said pressure chambers of said second set, wherein said ink flows paths lead to said corresponding nozzles.

* * * * *